United States Patent [19]

Davis

[11] 4,117,366

[45] Sep. 26, 1978

[54] RADIATION DETECTORS

[75] Inventor: Gordon Peter Davis, Sunbury-on-Thames, England

[73] Assignee: EMI Limited, Hayes, England

[21] Appl. No.: 519,218

[22] Filed: Oct. 30, 1974

[30] Foreign Application Priority Data

Nov. 3, 1973 [GB] United Kingdom ..... 51143/73

[51] Int. Cl.[2] ..... H01J 39/00; H01J 39/02

[52] U.S. Cl. ..... 313/95; 313/102

[58] Field of Search ..... 313/102, 95, 98; 250/213 VT

[56] References Cited

U.S. PATENT DOCUMENTS

| | | | |
|---|---|---|---|
| 3,634,690 | 1/1972 | Grant | 313/95 X |
| 3,701,901 | 10/1972 | Suhami et al. | 313/102 X |
| 3,825,787 | 7/1974 | Doolittle | 313/102 |
| 3,902,240 | 9/1975 | Chang et al. | 313/95 X |

*Primary Examiner*—Robert Segal

*Attorney, Agent, or Firm*—Cooper, Dunham, Clark, Griffin & Moran

[57] ABSTRACT

A multi-channel photomultiplier tube in which light radiation from distinct sources passes through an entrance window to a photo-cathode, the window being divided into parts so that light from a source passes through a respective part to an associated part of the photo-cathode, the division of the window into parts constraining the light from incidence upon other parts of the photo-cathode.

4 Claims, 3 Drawing Figures

RADIATION DETECTORS

Figure 1:
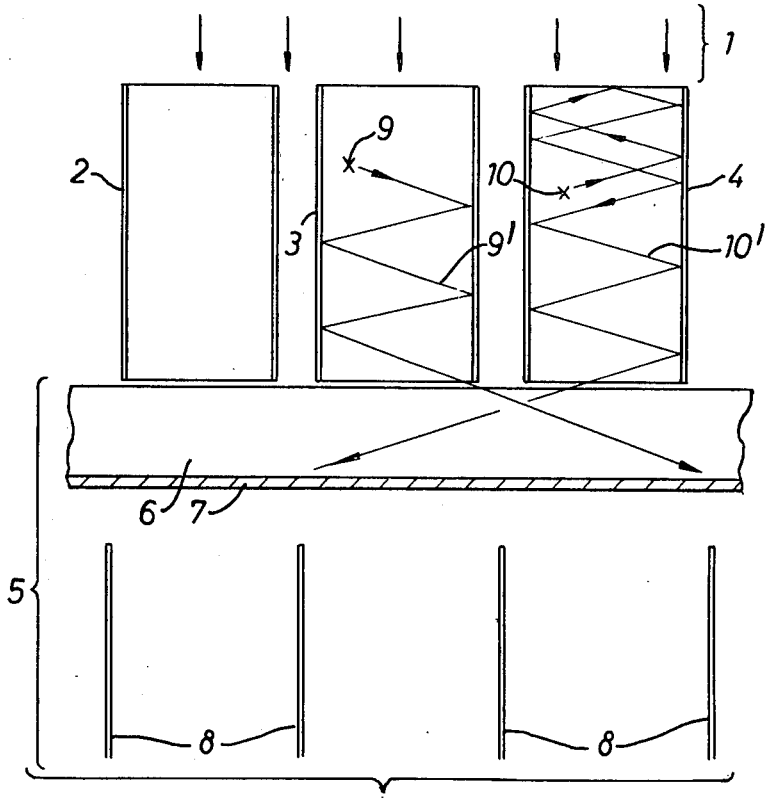

The present invention relates to pick-up tubes for radiation detection and more particularly but not exclusively to radiation detecting arrangements including pick-up tubes such as photomultipliers. Such arrangements are suitable for use in apparatus in which radiation is scanned over a body to be examined and the radiation emergent from the body is monitored. The amounts of radiation emergent along different paths from the body are correlated and processed so as to permit the evaluation of the absorption (or transmission) coefficients of the elements in a two dimensional matrix of elements notionally delineated in the body. Such an apparatus is described, for example, in the Complete Specification of our British Pat. No. 1,283,915.

In detecting the radiation simultaneously emergent from the body along several paths, it has been proposed hitherto to provide a plurality of scintillator crystals, each coupled to a respective photomultiplier tube. This arrangement results in the use of large numbers of small photomultiplier tubes, which is expensive and also gives rise to physical difficulties in stacking the tubes in closely spaced, side-by-side relationship.

The difficulties exemplified above make it desirable to have a single, multi-channel pick-up tube. In the above example a photomultiplier would be used to receive the scintillations from several scintillator crystals — with each crystal being allocated a respective channel of the photomultiplier. However, further difficulties arise in the use of such arrangements due to the fact that a multi-channel tube is of larger size and a vacuum device this window has to be of considerable thickness to provide strength. As the light energy produced in the scintillator crystals tends to be omni-directional, cross-talk between adjacent channels of the tube can occur, its occurrence being aided by the thicker window.

It is an object of this invention to reduce such cross-talk.

According to the invention there is provided a multi-channel pick-up tube having a vacuum envelope with an entrance window through which radiation can pass to a target, in which tube the window is solid and includes within its thickness regions which divide the window into areas each associated with a channel of the tube and obstruct the passage of radiation incident on an area of the window associated with one channel to the target associated with another channel.

A radiation detection arrangement includes a plurality of scintillator devices, a multi-channel pick-up tube having a target and solid entrance window through which light from said devices can be incident upon said target, wherein light emitted from each of said devices is constrained to enter a respective channel of said pick-up tube by baffle means incorporated in said window.

Preferably the baffle is formed by reflective metal strips inserted into slots cut in the window, the slots being filled in, the slots leaving enough thickness of window to support the pressure difference of the evacuated tube.

Figure 2:
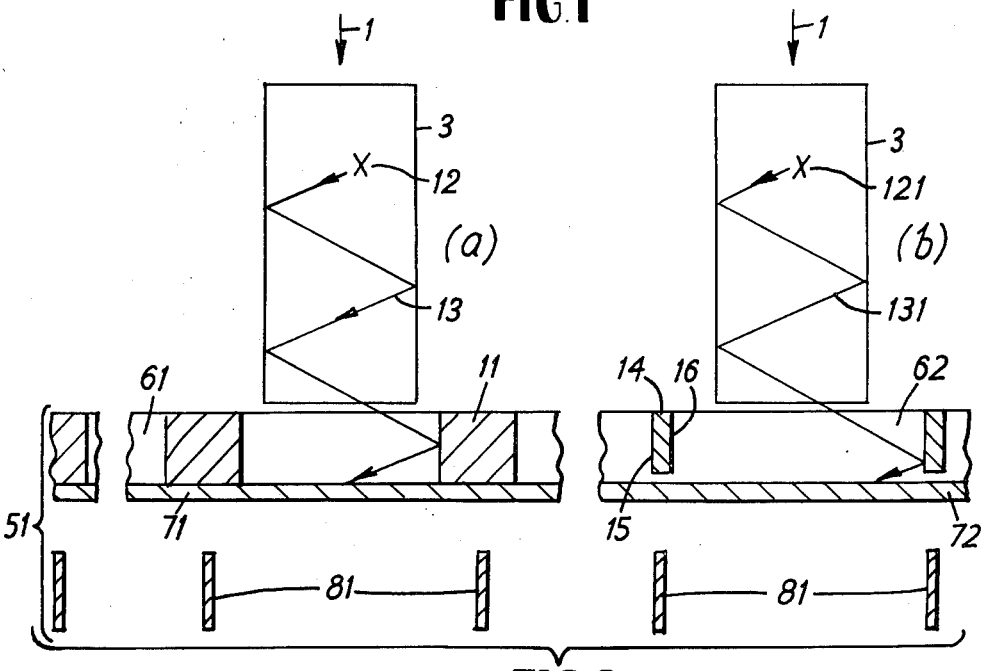
Figure 3:
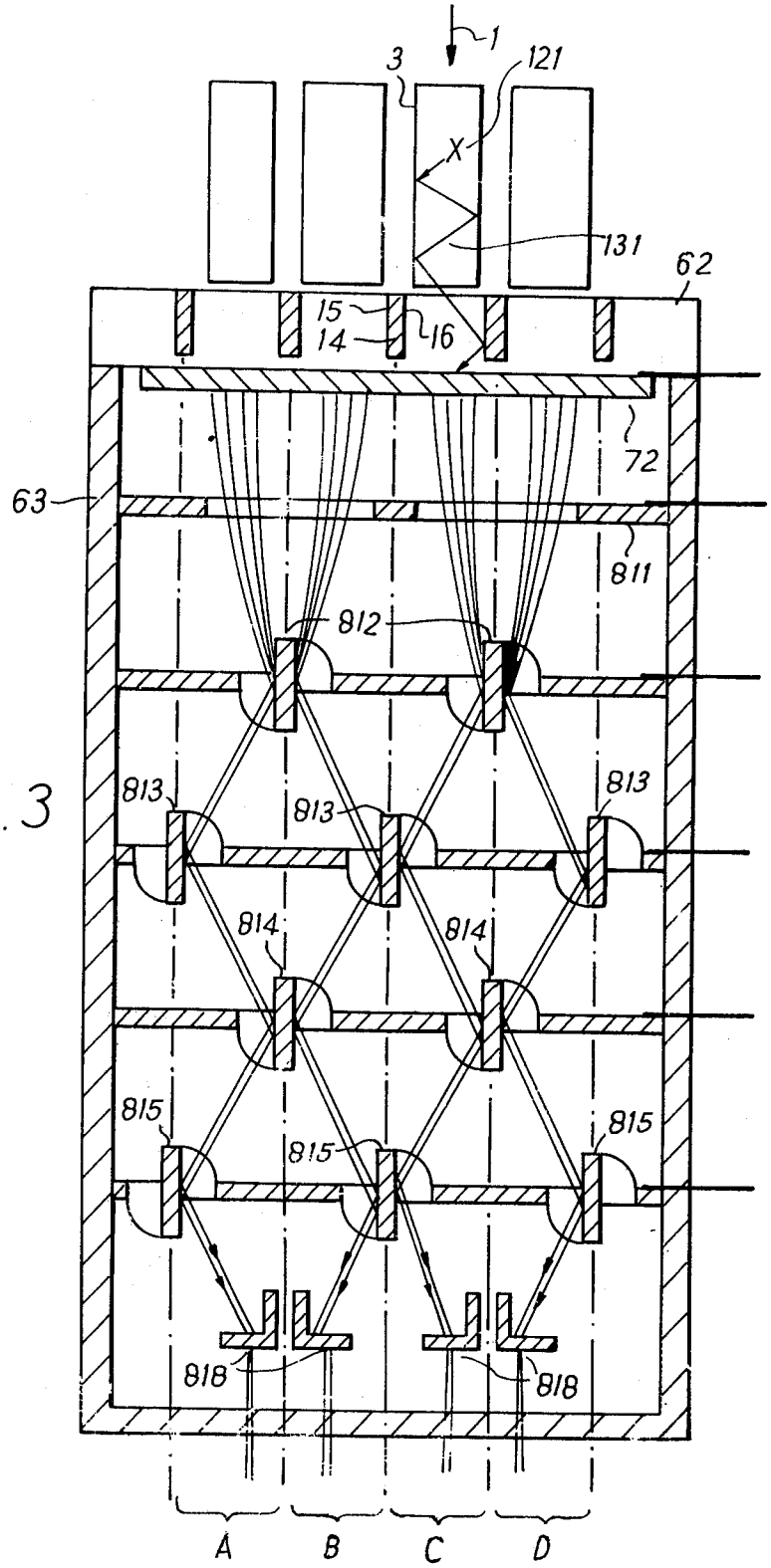

In order that the invention may be clearly understood and readily carried into effect, one embodiment thereof will now be described, by way of example only, with reference to the accompanying drawings of which:

FIG. 1 shows in schematic cross-section view, three adjacent scintillator crystals and part of a photo-multiplier tube and indicates the problem of cross-talk referred to previously, and FIG. 2 shows, in similar view to FIG. 1, part of two photomultipliers using different embodiments of the invention in an arrangement for detecting radiation from distinct sources and FIG. 3 shows a complete photomultiplier tube.

Referring now to FIG. 1, radiation, such as X-radiation, is incident as indicated by arrows 1 upon a bank of scintillator crystals of which only three, references 2, 3 and 4 respectively, are shown. The scintillator crystals can be of any kind known in the art.

Part of a multi-channel photomultiplier tube is shown generally at 5 and it includes an entrance window 6, a target such as a photocathode 7 deposited or otherwise provided on the inner surface of the window 6, and channel separating means 8. A suitable photomultiplier construction is shown in U.S. Pat. No. 3,872,337. FIG. 3 shows a photomultiplier tube as disclosed in this Patent modified to incorporate one of the embodiments shown in FIG. 2.

Typical scintillations are shown in crystals 3 and 4 by crosses 9 and 10 respectively, and it will be observed that it is possible in each case for light radiated from the crystal to follow a multi-reflected path (9′ and 10′ respectively) which emerges from the respective crystal at such an angle that, taking into account the thickness of the window 6, it passes into the adjacent channel of the photomultiplier. This phenomenon is referred to herein as cross-talk, since it results in information relating to one channel contaminating the information in an adjacent channel.

Clearly it is desirable to reduce cross-talk but two other factors are relevant. These are the minimum thickness of entrance window required to support the pressure difference across the tube and the distance between the light sources (e.g. the scintillation crystals) and the photo-cathode. Furthermore the channel separating means 8 are, in operation, maintained at a potential difference from the photo cathode 7 so a gap must exist between them and the photo cathode.

Referring now to FIG. 2*a*, metal inserts 11 are provided in the glass window 6 backed with photo-cathode 71. Preferably, each glass-metal interface is rendered optically reflective so that light from a scintillation in crystal 3 such as indicated by a cross 12 and following a path 13 which would, in the absence of the metal inserts 11, have been directed into the wrong channel of the photomultiplier 51, is not only prevented from being so directed but is also redirected into the correct channel. This expedient therefore not only reduces cross-talk but also increases the useful signal in each channel.

A suitable window 61 having inserts such as 11 can be made by forming a multi-layered glass-metal or metal alloy sandwich of materials having similar coefficients of thermal expansion. As a non-limitative example, the proprietary materials Kodial (Registered Trade Mark) glass and Nilo-K (Registered Trade Mark) metal alloy can be used, in which case the alloy should preferably be coated with silicon nitride to prevent oxide formation. Alternate layers of glass and strips of coated alloy are stacked until the required thickness is built up and the resulting stack is then subjected to heat and pressure so as to fuse the glass and alloy together to provide a unitary construction. Preferably, the heating is carried out under vacuum in order to prevent the entrappment of air during the fusing process. If required a glass layer can be attached to the underside of window 61. The glass layers may be silvered on their adjacent faces.

FIG. 2*b* shows an alternative form of construction for the window. A piece of glass 62 large enough to form the whole window has slots 14 cut into it to define parallel strips, one for each channel and coextensive with the apertures set by channel separating means 81. The slots may be cut by a diamond saw. Each slot has an interface e.g. 15, 16 with each adajcent glass panel. The slots are arranged to provide a baffle for light that could cause cross-talk. Thus a metal strip (not shown) may be inserted into each slot and the slot then filled with an epoxy resin adhesive to provide same mechanical stiffness of the window. The metal strip may be polished or silvered to provide a reflective layer at each interface. FIG. 2*b* shows that the baffle formed by slots 14 restricts the risk of cross-talk in the window. Only the glass left below each slot to provide the support against the pressure difference across the wall of the evacuated tube could permit cross-talk and as the end window is thick (c.6–10mm) the cross-talk aperture is very small. FIG. 3 shows the arrangement of FIG. 2*b* in a multichannel photomultiplier tube having an envelope 63, channel seperating electrodes 811, 812, 813, 814, 815 and anodes 818 for respective channels A, B, C and D and a photo cathode or target 72. Electrodes 818, 813, 814, 815 are dynodes for successive stages. The arrangement of FIG. 2*a* could replace that of FIG. 2*b*.

Other embodiments of the invention will be evident to those skilled in the art. For example the glass window need not be provided with metal inserts, but may instead be formed as a plurality of lenses, one for each channel.

What I claim is:

1. A multi-channel pick-up tube having a vacuum envelope with a solid entrance window through areas of which radiation can pass unobstructed to a target on the inside of the window for conversion to electrons and having a plurality of electrodes spaced along the tube length separating the inside of the vacuum envelope into a plurality of separate electron multiplication channels to respective anodes, the ends of the channel separating electrodes extending to adjacent the target and defining entrance apertures of the channels for electrons from the target, in which tube the solid window includes side-by-side within its thickness radiation obstruction regions aligned with respective channel separating electrodes which extend at least partly through the solid window and solid radiation-transmitting window areas each associated with a channel of the tube and which regions obstruct the passage of radiation incident on a said area of the window associated with one channel laterally through the window to a part of the target associated with another channel in which said regions are a baffle for visible light in said entrance window and in which the window is formed by a sandwich assembly of alternate layers of materials which transmit and do not transmit light.

2. A tube as claimed in claim 1 and in which said window includes said sandwich of layers and a further layer of light-transparent material extending across all the layer on the tube side of the window.

3. A tube as claimed in claim 2 and in which said sandwich is of layers of glass and a metal alloy of similar coefficient of thermal expansion.

4. A tube as claimed in claim 3 and in which the metal layers are coated with silicon nitride.

* * * * *